United States Patent [19]
Hibbard et al.
[11] 4,340,039
[45] Jul. 20, 1982

[54] HYDROMASSAGE APPARATUS

[75] Inventors: Neil K. Hibbard, Waukesha; Cliff J. Kinsey, Burlington; Clyde G. Belongia, Waterford, all of Wis.

[73] Assignee: Sta-Rite Industries, Inc., Milwaukee, Wis.

[21] Appl. No.: 161,162

[22] Filed: Jun. 19, 1980

[51] Int. Cl.[3] ..... A61H 9/00

[52] U.S. Cl. ..... 128/66; 4/542; 137/519.5; 137/615; 239/407; 239/428.5; 239/434; 251/208; 251/310

[58] Field of Search ..... 128/66, 67; 4/559, 455, 4/5.42, 492; 15/409; 210/202, 203, 449, 491; 261/116, DIG. 22, 77, DIG. 13, 39 R, 76, DIG. 75, 64 R; 417/78, 422, 181, 174, 424; 137/200, 202; 239/394, 428, 407

[56] References Cited

U.S. PATENT DOCUMENTS

| | | | |
|---|---|---|---|
| 2,738,787 | 3/1956 | Jacuzzi | 128/66 |
| 3,273,560 | 9/1966 | Jacuzzi | 128/66 |
| 3,279,703 | 10/1966 | Steizer et al. | 128/66 |
| 3,297,025 | 1/1967 | Jacuzzi | 128/66 |
| 3,745,994 | 7/1973 | Kane | 129/66 |
| 3,859,990 | 1/1975 | Simon | 128/66 |
| 3,890,656 | 6/1975 | Mathis | 128/66 |
| 3,905,358 | 9/1975 | Jacuzzi | 128/66 |
| 3,946,449 | 3/1976 | Mathis | 128/66 |
| 4,261,347 | 4/1981 | Spencer et al. | 128/66 |

*Primary Examiner*—Richard C. Pinkham
*Assistant Examiner*—T. Brown
*Attorney, Agent, or Firm*—Mason, Kolehmainen, Rathburn & Wyss

[57] ABSTRACT

Hydromassage apparatus for a whirlpool bath system includes a novel adjustable nozzle assembly adapted to be mounted on the wall of a bathtub or other water holding receptacle to directionally discharge a high velocity jet stream of fluid. The system includes a novel, venturi type, air injector for introducing air flow and intermixing air and water to form a high velocity, turbulent stream of fluid which is discharged from the directional nozzle assembly. The system further includes a novel air inlet control valve for selectively controlling the amount of air introduced into the water stream in the injector and the valve is also provided with a safety shut off capability for preventing the backflow of water out through the air inlet passage.

7 Claims, 11 Drawing Figures

FIG. 4
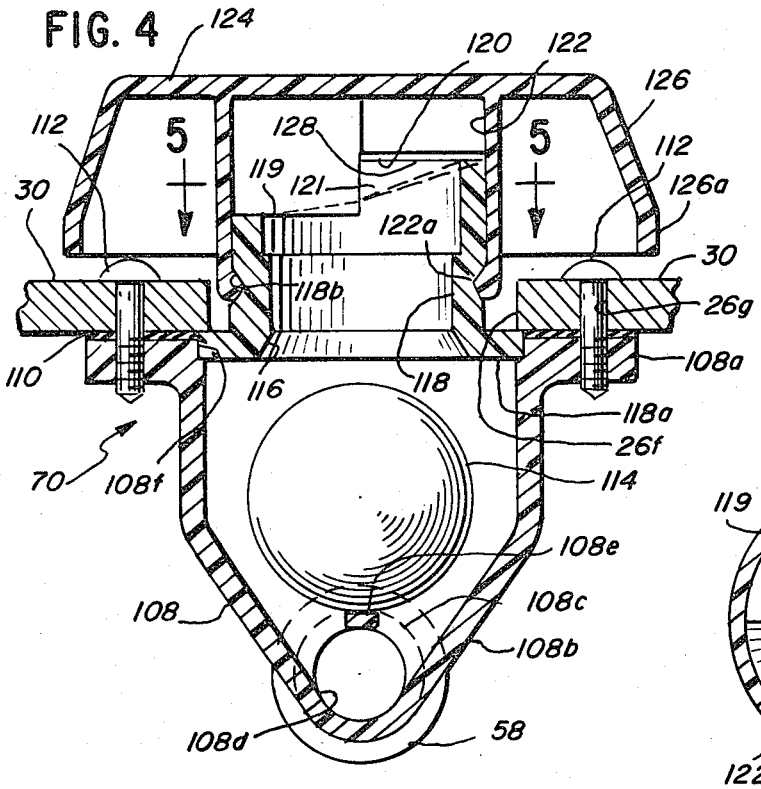
FIG. 5A
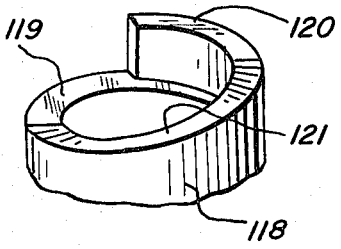
FIG. 5
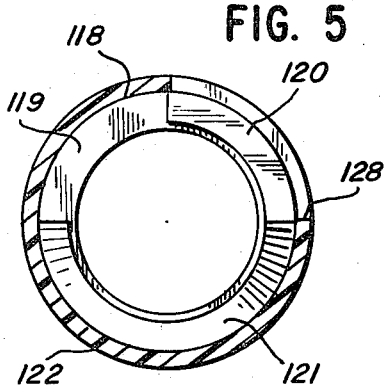
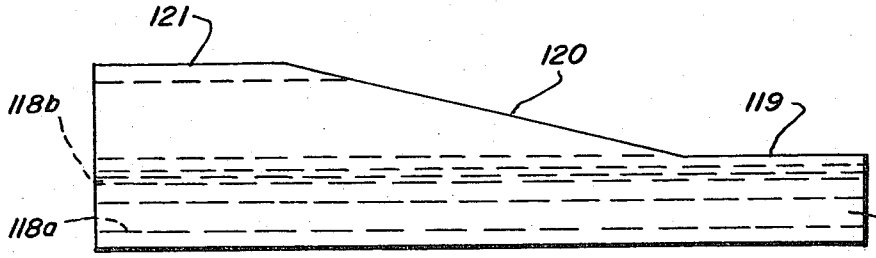
FIG. 6
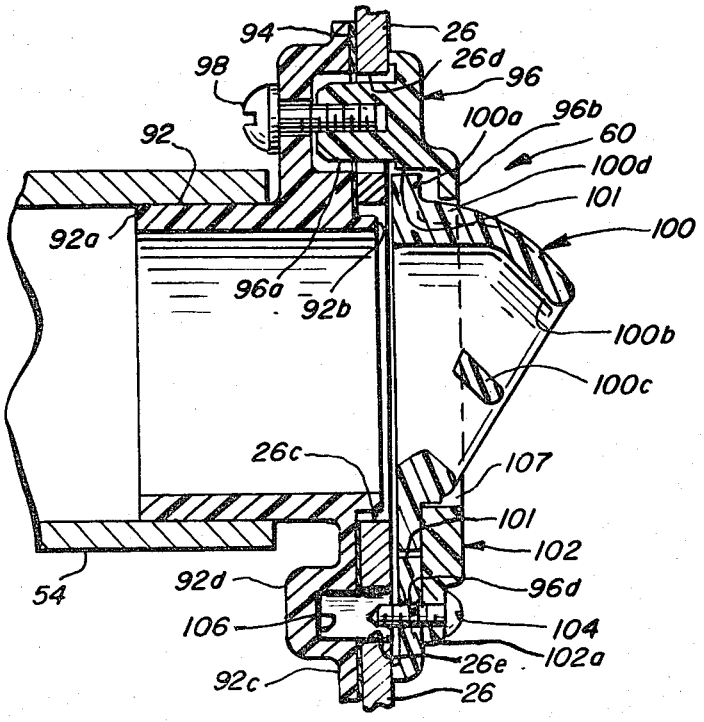
FIG. 7

FIG. 8
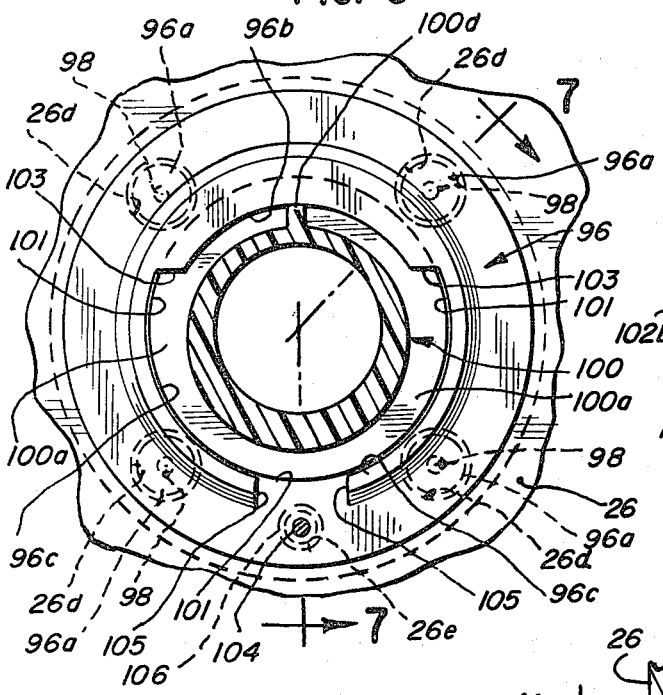
FIG. 9
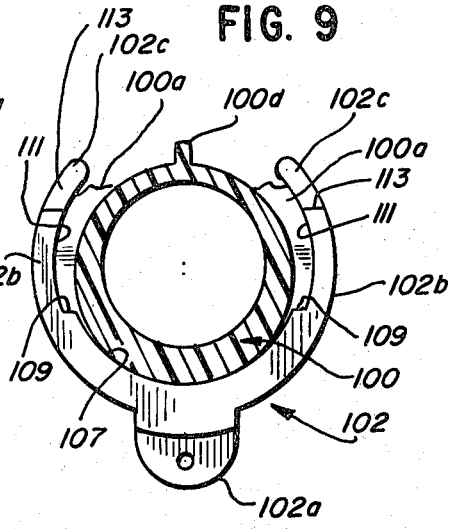
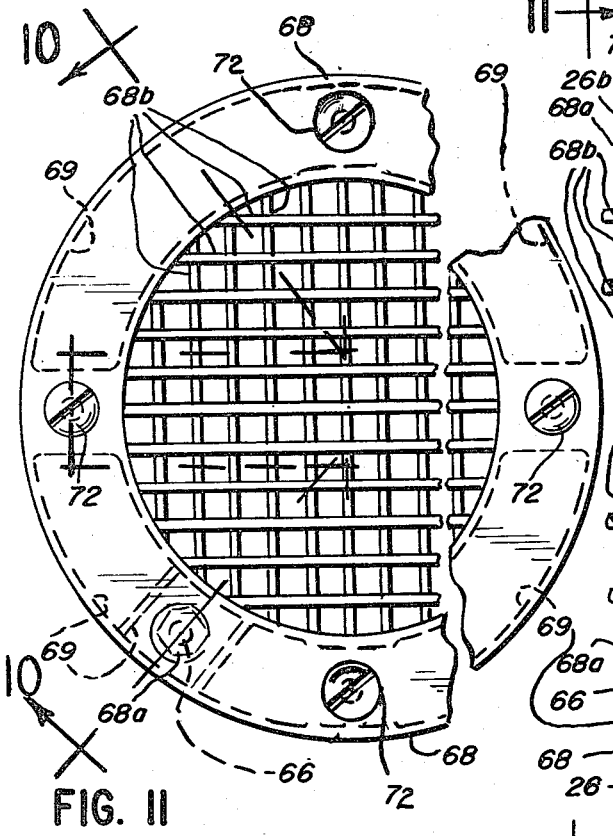
FIG. 11
FIG. 10
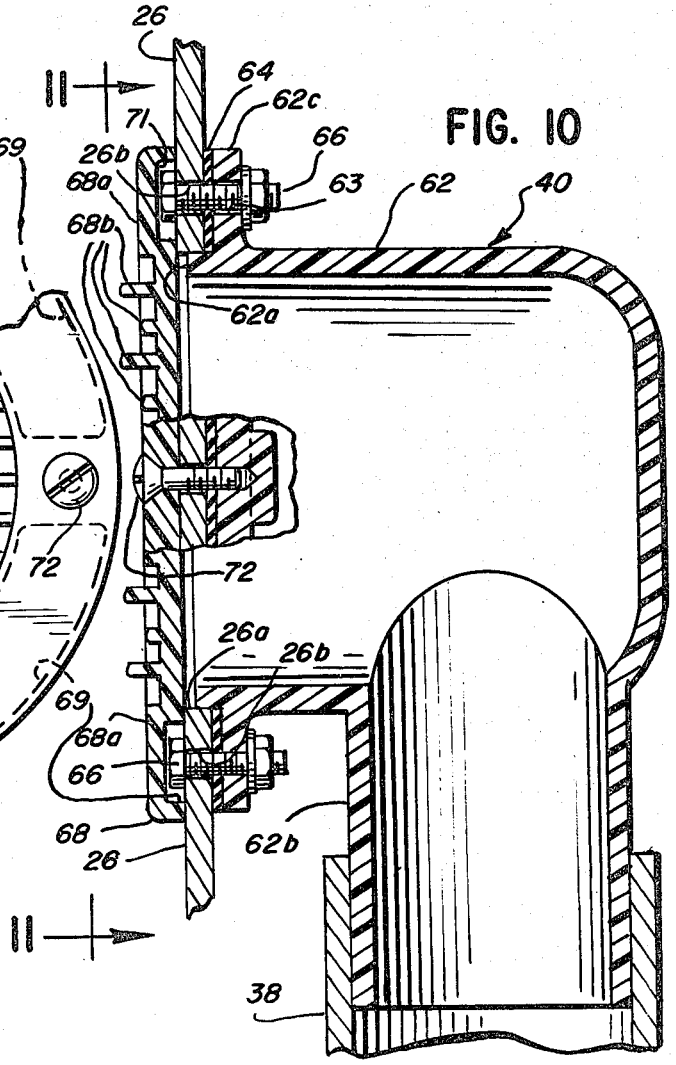

HYDROMASSAGE APPARATUS

BACKGROUND OF THE INVENTION

1. Field of the Invention

The present invention relates to a hydromassage apparatus for whirlpool bath systems in which an aerated flow of water is directionally controlled and discharged into a tub or other receptacle to provide hydromassage treatment. More particularly, the hydromassage system includes one or more manually controllable, directionally adjustable nozzle assembly adapted to be mounted on the wall of the tub or receptacle to discharge a high velocity jet stream of fluid into a tub at adjustable angle. The system also includes a novel, venturi action, air injector for producing a highly turbulent, high velocity fluid stream comprising a mixture of air and water and a novel air control valve is provided for selectively controlling the amount of air that is introduced into the flow of water in the system passing toward the nozzle assemblies. A safety valve is incorporated into the air control valve for preventing a back-flow of water which might otherwise spill out through the inlet air passage.

2. Description of the Prior Art

U.S. Pat. Nos. 2,210,846; 2,447,123 and 3,905,358 disclose venturi-type, air injectors for providing a turbulent, high velocity flow of air and water in a hydromassage system. U.S. Pat. Nos. 1,960,013, 2,539,280; 3,271,790; 3,628,529 and 4,098,851 also disclose venturi-type, air injectors wherein an upstream orifice that produces a high velocity jet stream of water is formed by a separate member. U.S. Pat. Nos. 442,809; 2,324,741 and 3,605,131 disclose directionally adjustable nozzle assemblies for use in whirlpool bath systems. U.S. Pat. Nos. 2,516,225; 2,738,787; 2,799,866; 3,292,615; 3,340,870; 2,345,982; 3,422,499; and 3,961,382 disclose air valves for whirlpool baths that provide adjustable, manual control for regulating the amount of air flow into the system.

OBJECTS OF THE PRESENT INVENTION

It is an object of the present invention to provide a new and improved hydromassage apparatus for whirlpool baths and the like.

Another object of the invention is to provide a new and improved hydromassage apparatus including a novel, venturi-type, air injector for introducing and intermixing air into a high velocity, turbulent jet stream of water.

SUMMARY OF THE INVENTION

The foregoing and other objects and advantages of the present invention are accomplished in a new and improved hydromassage system which includes one or more manually controlled, directionally adjustable, nozzle assemblies adapted to be mounted on the wall of a bathtub or receptacle to discharge a jet stream of fluid into the receptacle for hydromassage action. The nozzle assembly includes a nozzle forming element which is mounted for manual rotation on the tub wall and has an annular flange thereon which is retained in place on one side of the tub wall by a first retainer extending around and engaging a portion of the flange and a second, detachable, retainer which is secured onto the first retainer for engaging another portion of the flange of the nozzle forming element so that the element may be readily replaced, if required, without requiring working access to the opposite or hidden side of the wall.

The hydromassage apparatus also includes a novel, air injector of the venturi-type, having a water jet forming insert which is provided with a central passage to form a primary, axial flow jet stream and one or more, secondary passages spaced radially outwardly thereof for directing secondary jet streams inwardly into the primary jet stream to provide turbulent intermixing and introduction of a controlled amount of air from an annular air chamber at a point downstream of the jet stream forming passages. This provides a highly turbulent, high velocity flow of thoroughly intermixed air and water for the nozzle assemblies.

The hydromassage system also includes a novel, manually controllable, air inlet valve for permitting the selection of a desired amount of air to be introduced into the water flow. The valve provides for regulation of air flow from a shut off condition, linearly graduated to a maximum air flow condition dependent upon a selected angular position of a valve member. A water-buoyant, safety valve element is incorporated in the inlet valve to prevent a backflow of water out through the air inlet passage.

BRIEF DESCRIPTION OF THE DRAWINGS

For a better understanding of the present invention, reference should be had to the following detailed description when taken in conjunction with the drawings, in which:

FIG. 4 is an enlarged cross-sectional view of an air inlet control valve constructed in accordance with the features of the present invention, taken substantially along lines 4—4 of FIG. 1;

FIG. 5 is a transverse cross-sectional view across an inlet passage of the air inlet control valve taken substantially along lines 5—5 of FIG. 4;

FIG. 5A is a fragmentary, top side perspective view of an upper end portion of one element forming an air inlet passage of the air inlet control valve of FIG. 4;

FIG. 6 is a schematic representation or profile of the circumference around the upper end portion of the inlet passage of FIG. 5A;

FIG. 7 is an enlarged, longitudinally extending cross-sectional view of an adjustable nozzle assembly constructed in accordance with the features of the present invention, taken substantially along lines 7—7 of FIG. 1 and FIG. 8;

FIG. 8 is a front elevational view of the nozzle assembly of FIG. 7 but, with one of the retaining elements thereof removed;

FIG. 9 is a fragmentary, front elevational view illustrating the removed retaining element that is not shown in FIG. 8;

FIG. 10 is a cross-sectional view of a suction box constructed in accordance with the features of the present invention taken substantially along lines 10—10 of FIG. 11; and FIG. 11 is a front elevational view of the suction box member, looking in the direction of the arrows 11—11 of FIG. 10.

DESCRIPTION OF THE PREFERRED EMBODIMENT

Figures 1, 2, 3, 3A:
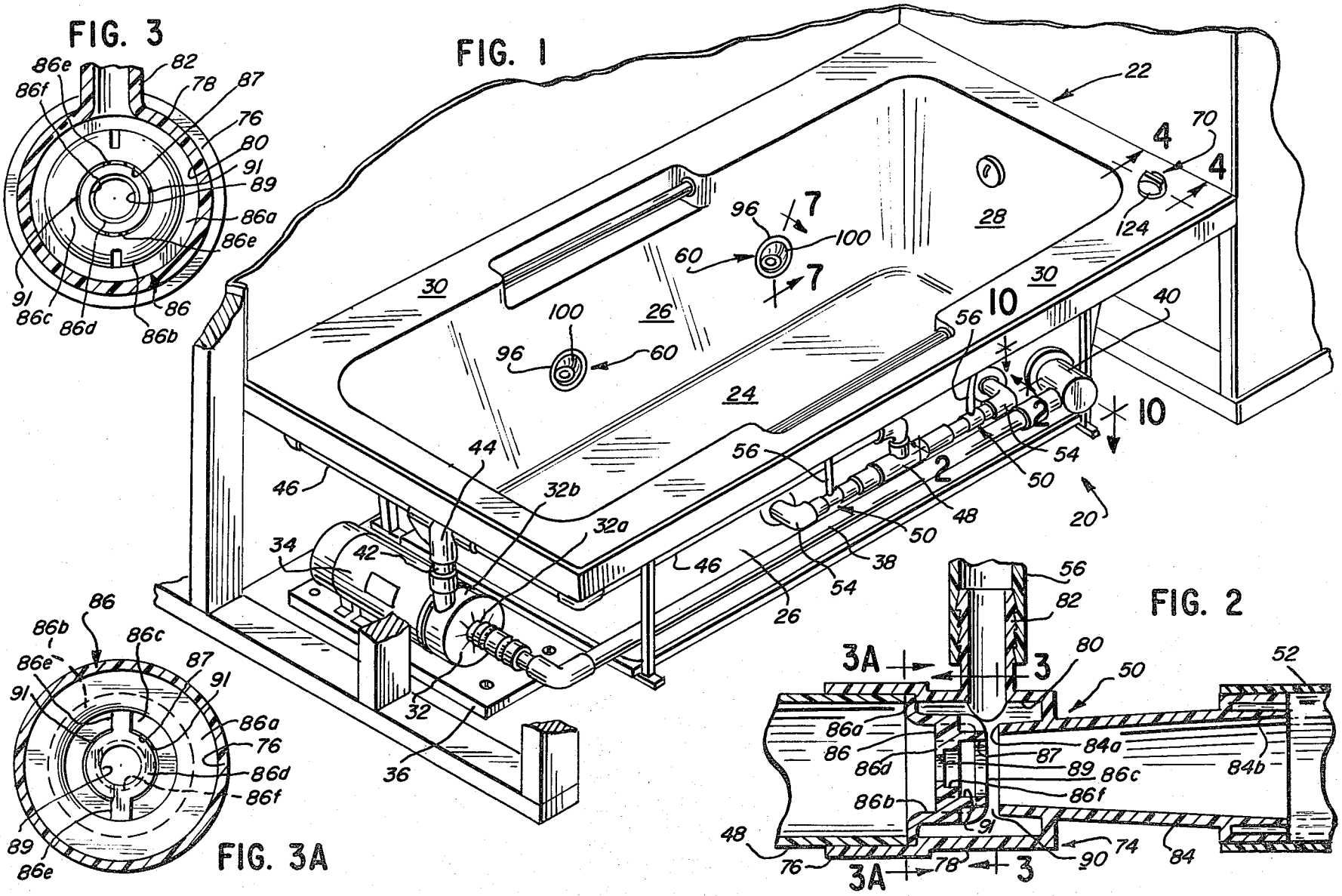
FIG. 1 is a front side, perspective view, with portions cut away and in section, illustrating a new and improved hydromassage system constructed in accordance with the features of the present invention.
FIG. 2 is an enlarged, longitudinal, cross-sectional view of an air injector in accordance with the present invention, taken substantially along lines 2—2 of FIG. 1.
FIG. 3 is a transverse cross-sectional view taken substantially along lines 3—3 of FIG. 2.
FIG. 3A is another transverse cross-sectional view taken substantially along lines 3A—3A of FIG. 2.

Referring now more particularly to the drawings, in FIG. 1 is illustrated and new and improved hydromassage apparatus for a whirlpool bath system constructed in accordance with the features of the present invention and referred to generally by the reference numeral 20. The system is adapted for application with a tub of almost any design or other types of water holding receptacles and by way of illustration, a tube 22 may include a bottom wall 24, a pair of integral sidewalls 26, a pair of front and rear end walls 28 and a generally horizontal, integrally formed peripheral flange 30 extending outwardly around the upper edges of the respective side and end walls of the tub. The tub may include a removable, outer sidewall (not shown) which encloses and covers one side of a peripheral access space to the system components around the outside of the respective end and sidewalls. The operating components and plumbing for the hydromassage apparatus are contained in this space and are hidden from view when the outer sidewall is in place.

Water for use in the hydromassage provided by the whirlpool bath system is supplied to the tub and is drainable therefrom in a conventional manner and the temperature of the water is usually selectively controlled as the tub is being filled, although auxiliary heaters may be provided.

The system includes a water circulating pump 32 driven by an electric motor 34, both of which are mounted on a base plate 36 secured to an underlying supporting floor or other surface at the rear end of the tub below the flange 30 or at other convenient location. The pump includes a suction inlet **32*a* which is supplied with water from the tub through an inlet supply conduit 38 connected to a suction box 40 shown in enlarged detail in FIGS. 10 and 11 and which may be mounted at any convenient location such as on the sidewall 26 at a lower level adjacent the forward end. A pressure outlet 32*b* of the pump is connected via a short conduit 42 to a dividing tee 44 having opposite branches connected to a pair of pressure conduits 46 extending longitudinally of the tub sidewalls 26 beneath the horizontal side flanges 30. These conduits supply water to a pair of tee fittings 48 having opposite outlet branches connected to the inlet end of a pair of air injectors 50 which are shown in enlarged detail in FIGS. 2, 3 and 3A** and which are constructed in accordance with the features of the present invention.

The outlet end of each air injector may be connected via a conduit 52 to an elbow 54 or directly to an elbow, depending on the tub design, in order to supply a flow of high velocity, aerated water to one or more nozzle assemblies 60 which are constructed in accordance with the features of the present invention and which are shown in greater detail in FIGS. 7, 8 and 9. In the illustrated embodiment, a pair of nozzle assemblies 60 is mounted on each of the tub sidewalls 26 at an appropriate level therein and it is to be understood that additional nozzle assemblies can be included if desired, or a lesser number of nozzle assemblies may also be provided depending upon the size of the tub or receptacle involved and the particular type of hydromassage installation.

When desired, ambient outside air may be supplied to the air injectors 50 through air supply hoses 56 which are interconnected and supplied by a common branch conduit 58 mounted on each side of the tub beneath the flange 30. These conduits are interconnected to the outlets of a manually controllable, air inlet and safety valve 70 which is constructed in accordance with the features of the present invention and which is mounted at a convenient location for ready manipulation on the upper, horizontal flange 30 of the tub at the head end.

Referring now more particularly to FIGS. 10 and 11, the suction box 40 includes a hollow body 62 preferably formed of molded resinous plastic material which is light in weight, strong and resistant to corrosion and the accumulation of scale thereon. The body 62 includes an open circular inlet end portion **62*a* which is seated in a circular opening 26*a* formed in one of the tub side walls. The body includes an outlet section 62*b* of circular transverse cross-section having a diameter somewhat less than that of the inlet end section. The outlet section extends at right angles to the axis of the inlet section and is connected to the inlet conduit 38 leading to the inlet 32*a* of the pump 32**.

The body 62 is formed with a radial mounting flange **62*c* adapted to abut the surface of the tub wall 26 around the opening 26*a* and is sealed against the tub wall by means of sealant material 64. The suction box housing is secured in place on the tub wall by a plurality of fasteners 66 in the form of headed cap screws which may be formed of plastic or non-corrosive metal and including washers and nuts threaded onto the shank of the cap screws adjacent the back face of the flange 62*c*. The fasteners 66 are located at circumferentially spaced positions on the flange and the shanks pass through openings 26*b* formed in the tub wall and aligned openings 63 formed in the flange 62*c*** of the suction box body.

On the inside surface of the tub wall 26, the suction box is provided with a circular, grill ring 68 having an outer annular rim portion **68*a* and a central portion with a plurality of integrally formed, transversely intersecting ribs 68*b* forming a grill or screen for preventing objects of relatively large size from passing into the hollow suction body 62. On the inner face, the rim 68*a* is formed with a plurality of, relatively large, arcuately shaped recesses 69 for lightening the weight and conserving material and at diametrically opposed positions adjacent the headed fasteners 66, a plurality of smaller, arcuately shaped recesses are formed to receive the heads of the cap screws as shown in FIGS. 10 and 11**.

The inlet grill ring 68 is secured in place by a plurality of self-tapping, countersink head, screw fasteners 72 positioned at diametrically opposed points around the outer rim **68*a* radially spaced from the cap screw fasteners 66. The shanks of the fasteners 72 extend through openings 26*b* in the tub walls to tap into thickened portions of the flange 62*c* on the suction box body 62 as shown. Should the ribs 68*b* become damaged or broken, necessitating replacement of the inlet grill 68, it is a relatively simple matter to remove the screw fasteners 72 and subsequently replace the ring. This is done without requiring removal or detachment of the suction box body 62 from the tub wall 26. The ribs 68*b*** may be of alternately varying thickness as shown to help prevent suction obstruction.

Referring now to FIGS. 2, 3 and 3A, the air injector 50 is of the venturi-action type and is adapted to provide a high velocity jet stream of turbulent, aerated water for the hydromassage apparatus. The air injector includes a generally cylindrical, elongated hollow body 74 preferably formed of molded resinous plastic material and formed with an open ended inlet section 76 having a diameter slightly larger than an intermediate section 78 which forms the outer wall of an annular air chamber 80.

The air chamber annulus is supplied with air from the conduit 56 which is attached to a radially outwardly extending inlet fitting 82 on the intermediate section 78 and the fitting is formed with ridges and grooves on the outer surface thereof in order to tightly seal with the end of the hose conduit in an air tight connection. The elongated body also includes a nozzle outlet section 84 having an open outer end portion provided with an annular groove therein to lighten the weight and conserve expensive material. The outlet section 84 tapers from a minimum diameter inlet end 84*a* spaced inwardly of the annular air chamber 80 and forming a forward portion of the inner wall thereof to a maximum diameter outer end portion 84*b* connected to the conduit 52. The outlet section 84 provides an expanding nozzle for the turbulent, aerated flow of air and water mixture formed in the air injector 50.

In accordance with the present invention, the air injector includes a nozzle insert 86 having an annular, outwardly extending radial flange 86*a* which is seated against a recess or shoulder formed at the junction between the inlet section 76 and the smaller diameter intermediate wall section 78. The nozzle insert includes an annular, generally cylindrical intermediate skirt wall 86*b* forming a rear segment of an inner wall for the annular air chamber 80. The forward end of the skirt wall 86*b* terminates upstream of and is spaced from the inner end 84*a* of the outlet nozzle section 84 as shown in FIG. 2. The nozzle insert also includes an annular, front end wall 86*c* integrally joined with the cylindrical skirt wall 86*b* at the forward end with a rounded transition portion as shown. The radial end wall 86*c* is formed with an enlarged circular opening 87 having a diameter slightly less than the inside diameter of the inner end 84*a* of the outlet nozzle section 84. Upstream of the radial, annular front end wall 86*c*, the nozzle insert is formed with a radially disposed annular wall segment 86*d* integrally secured to the skirt wall 86*b* by a pair of diametrically opposed radial arm segments 86*e* as best shown in FIG. 3A. The segment 86*d* is formed with a centrally disposed, circular passage 89 which defines a center nozzle orifice that forms a primary, high velocity jet stream of water which flows axially along the longitudinal axis of the air injector.

Between the small diameter passage or opening 89 and the larger opening 87 at the front end of the nozzle insert, there is provided an inner, annular cylindrical skirt wall 86*f* of intermediate diameter and this arrangement provides for a stepped diameter orifice structure having three segments of increasing diameter in a direction downstream of the first, small diameter opening 89. The nozzle insert 86 is formed with a plurality of outer, secondary passages 91 which direct secondary jet streams of water from a position outwardly around the inside surface of the skirt wall 86*b* inwardly toward the center axis to angularly intersect the flow axis of the primary jet stream of water flowing through the stepped diameter passages of the nozzle insert. This arrangement provides for high turbulence in the area and this turbulent flow is highly efficient in mixing air and water and drawing air by venturi-action into the water streams from an annular open space 90 formed between the radial end or front wall 86*c* of the nozzle insert and the inlet end 84*a* of the outlet nozzle section 84 of the air injector.

The air injectors 50 provide a highly efficient turbulent mixing and venturi-type suction action to induce air flow into the primary and secondary convergent water streams and this aerated mixture is carried to the respective nozzle assemblies 60 mounted on the side walls 26 of the tub or receptacle 22 to provide hydromassage action. Preferably, the separate nozzle inserts 86 are formed of molded resinous plastic material as in the body 74 of each air injector. The high velocity turbulent fluid stream of air and water from each of the air injectors is directed via the elbows 54 to the inlet side of the respective adjustable nozzle assemblies 60 on the tub walls 26.

Each nozzle assembly includes a hollow body 92 having an inlet end 92*a* in communication with the outlet of a tee 54 and an outlet end 92*b* mounted to extend into a circular opening 26*c* formed in the tub wall at the desired location. The body also includes an integrally formed, radially outwardly extending annular flange 92*c* having a planar face adapted to be sealed against the back face of the tub wall around the circular opening 26*c* by sealing material 94. The body flange 92*c* is secured to the tub wall by means of a circular shaped, annular flange ring 96 mounted adjacent the tub wall and secured with the flange 92*c* of the body by a plurality of cap screw type fasteners 98 having threaded shanks which project into threaded inserts provided in circular bosses 96*a*. These bosses have axial bores on the backside for receiving the fastener shanks and are dimensioned to extend through respective openings 26*d* formed in the wall 26 of the tub in a ring around the large diameter, central opening 26*c*.

Each nozzle assembly 60 includeds a manually controllable, nozzle outlet element 100 having a circular base flange 100*a* formed at the inlet end and mounted to rotate within a large, centrally disposed, circular opening 101 defined in the retaining ring 96. The nozzle element 100 includes an outlet end 100*b* which is open and lies on a plane angularly disposed in relation to a longitudinal flow axis of the body 92. Accordingly, the fluid stream of air and water mixture discharged from the outlet end of the nozzle element is directed with an angular component dependent upon the relative rotational position of the nozzle element in the retaining ring 96. An integral, transverse rib 100*c* is formed to extend transversely across the outlet end of the nozzle element and this rib aids in directionalizing the aerated fluid stream from the nozzle assembly.

Referring now more particularly to FIGS. 7 and 8, the annular retaining ring 96 is formed with an upper, overhanging, arcuate rib 96*b* for retaining an upper portion of the circular annular flange 100*a* of the nozzle element in place within the circular opening 101. As viewed in FIG. 8, the arcuate shaped, overhanging rib 96*b* is continuous for approximately 150° around the top of an arc concentric of the longitudinal axis of the body 92. The rib is sharply discontinued at stop surfaces 103 so that the flange 100*a* of a nozzle element may be slipped into place from the exposed side of the tub wall 26 under the overhanging rib without requiring removal of the retaining ring 96. Once the nozzle element 100 is slipped into place with the flange 100*a* thereof seated for free rotation within the circular opening 101 of the ring 96, a second retainer 102 shaped to resemble a "C-ring" (FIG. 9) is inserted into the lower portion of the opening 101 from the lower end portion thereof to overlie and retain the nozzle element 100 in place. The "C-ring" 102 is secured in place by a single fastener 104, the shank of which extends through an opening in a downwardly extending radial tab portion 102*a* of the "C-ring" adapted to fit between the lower ends of a pair of arcuate side ribs 96*c* which extend downwardly from the lower end stop surface 103 of the upper, overhanging rib 96*b*.

At the lower ends, the lower side ribs 96*c* terminate at stop faces 105 which are spaced apart slightly larger than the width of the downwardly extending tab 102*a* on the "C-ring" retainer 102. The flange of the nozzle body 92 is formed with a cylindrical boss 92*d* at the lower portion having an outwardly facing hollow bore 106 adapted to receive the shank of the single retaining fastener 104. The fastener shank 104 extends through an opening 26*e* in the tub wall and the opening is aligned with the bore 102 and the fastener is theadedly engaged in a ring hole 96*d* formed in the lower end portion of the annular retainer ring 96 to hold the C-ring in place. The "C-ring" retainer 102 includes a pair of arcuately curved upwardly extending side fingers 102*b* having curved inner surfaces 107 arranged to lie on cylindrical surface or circular portion slightly larger in diameter than the outer diameter of the adjustable nozzle element 100 at the inlet end.

Referring to FIG. 9, at an intermediate level above stop surfaces 109, each finger 102*b* is reduced in width and includes a curved inner surface 111 lying on a cylindrical surface of a diameter slightly larger than the diameter of the lower finger portions as indicated by the numeral 107. Uppermost portions of the "C-ring" fingers 102*c* above a second pair of stop surfaces 113, have curved inner surfaces of the same diameter as the intermediate portions 102*b* but, are of a reduced thickness to slip under the overhanging rib 96*b* of the circular ring 96. The nozzle element 100 includes a rib 100*d* formed on the upper surface and the nozzle and rib is freely rotatable between the "C-ring" fingers 102*b* until the rib 100*d* engages either of the stop surfaces 109 at a lower level on a finger 102*b*.

The thin upper end 102*c* above the stop surface 113 of each finger permits the "C-ring" to be slipped into place to secure the nozzle element 100. The stop surfaces 113 are adapted to abut the stop surfaces 103 on the overhanging rib 96*b* of the annular retainer ring 96 when the "C-ring" retainer 102 is fully inserted upwardly into place. It should be noted that the outer surface of the overhanging rib portion 96*b* is on a plane substantially coextensive with the outer surface of the lower portion of the "C-ring" fingers 102*b* beneath the stop surfaces 113 so that when the "C-ring" is inserted into place and the tab 102*a* is secured to the ring 96 by a single fastener 104, the cooperating retainer ring 96 and "C-ring" 102 provide a neat appearance and a smooth annular face around the nozzle structure 100. Should a nozzle 100 become broken or clogged, the element may be readily removed for replacement, simply by loosening a single cap screw 104 and withdrawing the "C-ring" retainer 102 downwardly until the upper ends 102*c* of the finger are below the rib 96*b* of the retainer. When this is done, the nozzle element 100 can then be slipped out of the circular opening 101 in the annular retainer ring 96. The ring 96 is maintained continuously in place and does not have to be removed when replacing a nozzle element 100 or inserting a "C-ring" retainer 102. Both the ring 96 and "C-ring" 102 cooperate to support and retain the rotatable nozzle element 100 in place and the stop surfaces 109 provide positive limits of nozzle rotation. Access to the backside of the tub wall is not needed for replacement of a nozzle element and only a single fastener is required to secure the element and "C-ring" in place.

Referring now more particularly to FIGS. 4, 5, 5A and 6, the hydromassage apparatus 20 includes the manually operable air control valve 70 for selectively regulating the amount of air introduced into the flowing water through the air injectors 50. The control valve is adapted to be mounted in a convenient location, for example, on the horizontal tub flange 30 within convenient reach of a person sitting in the tub. The flange is formed with a circular opening 26*f*. The air control valve includes a body member 108 in coaxial alignment with the axis of the opening and preferably is formed of molded resinous plastic material. The body has a circular shaped, open upper end and a radial flange 108*a* extending outwardly thereof is sealed against the underside of the tub flange by sealing material 110 as illustrated.

The valve body is held in place by a pair of self-tapping fasteners 112 which extend downwardly through openings 26*g* drilled or punched in the tub flange at diametrically opposed positions outside of the large, centrally disposed circular opening 26*f*. At the lower end, the hollow body 108 is formed into a V-shaped trough structure 108*b* with a pair of outwardly extending nipple-like, outlet tubes 108*c* on opposite sides which are connected to the air conduit tubing 58 leading to the air inlet stems 82 on the respective air injectors 50. Similar to the stems 82, the outlet tubes 108*c* are formed with alternate rings of ridges and grooves to form an air tight interconnection with the tubing 58 attached thereto. Opposite sides of the lower end portion of the housing are formed with a pair of circular shaped outlet openings 108*d* to direct air flow out into the conduits 58 in communication with the outlet tubes.

Above the upper edges of the respective outlet openings 108*d*, there is provided a transverse stem or rib 108*e* that is integrally formed to extend between opposite sides of the body. The rib provides support for a spherically-shaped, water buoyant valve element or ball 114 which is loosely carried in the housing and adapted to move upwardly in response to a back flow of water that might come into the housing body from the tubes 58. The valve ball is adapted to provide a safety shut off for preventing any outflow or back up of water out of the top of the valve and is adapted to seat and close against a frustoconical valve surface 116 formed at the lower end of a hollow, tubular air inlet conduit 118 having a radial flange 118*a* integrally formed at the lower end and adapted to seat in a shoulder or groove 108*f* formed in the upper end of the body 108.

The flange 118*a* of the inlet conduit 118 is adhesively or otherwise sealed tightly to the surface of the groove 108*f*. The air inlet conduit 118 has a large circular bore between upper and lower ends to admit air flow into the valve body from the ambient atmosphere above the tub. In order to provide for selective control of the air flow between a fully closed or shut off condition and a fully open position for maximum flow rate, the upper edge of the conduit is formed with a contour or profile having a first or lower horizontal segment 119 extending around approximately one-quarter of the conduit circumference and immediately adjacent thereto, a maximum height or shut off segment 120 is provided having a horizontal upper surface spaced above the segment 119 and also occupying approximately one-quarter of the circumference of the inlet conduit. The segments 119 and 120 are interconnected by a helically sloped, graduated control segment 121 which covers the remaining 180° of the circumference of the tubular conduit between the lower section 119 and the upper section 120.

The tubular inlet conduit 118 is formed with an annular groove 118*b* around the outer surface thereof and detachably seated within this groove is an inwardly extending annular rib 122*a* formed adjacent the lower edge of a generally cylindrical, skirt-like control element 122 depending downwardly from the underside of a rotatable cap 124 which provides for manual control of the air valve. The cap includes a frustoconically shaped, downwardly depending, outer skirt 126 having a cylindrical lower end portion 126*a* and this portion is spaced above the upper surface of the tub flange 30 to permit air to flow freely into the area around the control element 122 of the valve.

As best shown in FIG. 5, an arcuate segment 128 of the depending skirt element 122 is cut away or absent from the complete circumference of the skirt and this provides a cooperative air inlet opening so that a selective control of the flow of air is attained by manipulating the rotative position of the cap with respect to the upper edge of the inlet conduit 118. Whenever the cap 124 is rotated to a position wherein the open 90° segment 128 is in line or registration with the upstanding high level shut off segment 120 of the inlet conduit 118, all air flow is cut off. Manual rotation of the cap 124 from the shut off position results in a selectively controlled amount of open area for the ambient air to enter into the inlet conduit 118. When the segment 128 of the cap skirt 122 is moved into registration above the lowest segment 119 of the tubular conduit 118, a maximum air flow is provided and this is a fully open position. Intermediate positions between the closed or shut off position shown in FIG. 5 and the fully open position, results in a graduated amount of area being available for the inflow of ambient air and thus, the valve provides for positive control and convenient means for regulating air flow. The cap skirt 122 is flexible enough so that the cap may be removed entirely from the upstanding wall of the tubular inlet section 118 when desired and when in place above the tub flange 30, the cap provides a nice, neat appearing control element for the system.

Although the present invention has been described with reference to a single illustrated embodiment thereof, it should be understood that numerous other modification and embodiments can be devised by those skilled in the art that will fall within the spirit and scope of the principles of this invention.

What is claimed as new and desired to be secured by Letters Patent of the United States is:

1. In a hydromassage system, an air injector for introducing air into the flow of water:

said injector comprising an elongated, tubular housing having an inlet end section for receiving a flow of water moving in an axial direction and an outlet end section for discharging a high velocity, turbulent flow of air and water;

said inlet end section having a substantially cylindrical body with a downstream end secured to an inner end portion of said outlet end section and defining an annular air chamber around said inner end portion;

means for directing air into said annular air chamber;

said outlet end section comprising a divergent nozzle structure in coaxial alignment with said cylindrical body and increasing in transverse dimension from an inlet end toward an outer end portion, said inlet end being adjacent and downstream of said annular air chamber; and nozzle insert means comprising an annular, outwardly extending radial flange secured at the outer periphery to said body, a cylindrical skirt wall secured to said flange and extending downstream, a wall segment extending radially from said skirt wall and secured thereto by arm segments, a center nozzle orifice in said wall segment that forms a primary, high velocity jet stream, an annular skirt wall secured to and extending downstream of said wall segment, said annular skirt wall being of a larger diameter than said nozzle orifice, an annular front end wall secured to and extending downstream of said annular skirt wall, said front end wall being of a larger diameter than said skirt wall such that said nozzle orifice, said annular skirt wall and said front end wall provide a stepped diameter orifice structure, and one or more outer passages formed around said primary jet stream adjacent to and upstream of said front end wall and adjacent to and downstream of said inlet end of said outlet end section for directing one or more secondary high velocity streams of water inwardly toward said primary jet stream for turbulent intermixing therewith, wherein said high velocity streams of water from said nozzle insert means entrains air from said annular air chamber into said high velocity streams by venturi action in a region between said front end wall and said inlet end of said inlet end section.

2. The air injector of claim 1 wherein said outer passage(s) are defined on a cylindrical high velocity water stream formed by said nozzle insert means.

3. The air injector of claim 1 wherein said nozzle orifice is smaller in diameter than said inlet end of said nozzle structure.

4. The air injector of claim 1 wherein said end wall and said annular skirt wall are integrally joined at a downstream end having a rounded outer surface at the junction forming an inside wall surface of said annular air chamber for directing air flow into water streams in the region between said end wall and said inlet end of said nozzle structure.

5. The air injector of claim 1 wherein said inlet end section includes a bore having a stepped diameter with an upstream end having a larger diameter forming an annular shoulder, said insert radial flange at the upstream end seated against said shoulder.

6. The air injector of claim 5 wherein said radial flange is integrally joined to the upstream end of said cylindrical skirt wall to provide spacing between said cylindrical skirt wall and a smaller diameter portion of said stepped diameter bore to form an upstream portion of said annular air chamber.

7. The air injector of claim 5 wherein said tubular housing includes an inwardly extending annular end wall at a downstream end secured to said nozzle structure downstream of said inlet end.

* * * * *